US005740545A

United States Patent [19]

Maxwell et al.

[11] Patent Number: 5,740,545

[45] Date of Patent: Apr. 14, 1998

[54] BAGLESS TRANSFER PROCESS AND APPARATUS FOR RADIOACTIVE WASTE CONFINEMENT

[75] Inventors: David N. Maxwell, Aiken, S.C.; Robert H. Hones, Evans, Ga.; M. Lane Rogers, Aiken, S.C.

[73] Assignee: Westinghouse Savannah River Company, Aiken, S.C.

[21] Appl. No.: 546,566

[22] Filed: Oct. 20, 1995

[51] Int. Cl.[6] ..... G21F 9/00

[52] U.S. Cl. ..... 588/1; 588/16; 83/54; 83/930; 83/946

[58] Field of Search ..... 588/1, 16; 83/54, 83/930, 946

[56] References Cited

U.S. PATENT DOCUMENTS

| | | | |
|---|---|---|---|
| 4,590,000 | 5/1986 | Baatz et al. | 588/16 |
| 4,629,587 | 12/1986 | Monden et al. | 53/526 |
| 4,847,009 | 7/1989 | Madle et al. | 588/16 |
| 5,064,575 | 11/1991 | Madle et al. | 588/16 |
| 5,203,244 | 4/1993 | Guigon et al. | 83/153 |
| 5,391,887 | 2/1995 | Murray, Jr. | 250/506.1 |
| 5,523,519 | 6/1996 | Weber et al. | 588/249 |

*Primary Examiner*—Ngoclan Mai

*Attorney, Agent, or Firm*—Hardaway Law Firm, P.A.

[57] ABSTRACT

A process and apparatus is provided for removing radioactive material from a glovebox, placing the material in a stainless steel storage vessel in communication with the glovebox, and sealing the vessel with a welded plug. The vessel is then severed along the weld, a lower half of the plug forming a closure for the vessel. The remaining welded plug half provides a seal for the remnant portion of the vessel and thereby maintains the sealed integrity of the glovebox.

5 Claims, 3 Drawing Sheets

BAGLESS TRANSFER PROCESS AND APPARATUS FOR RADIOACTIVE WASTE CONFINEMENT

The United States Government has rights in this invention pursuant to Contract No. DE-AC09-88SR18035 between the U.S. Department of Energy (D.O.E.) and Westinghouse Savannah River Company.

BACKGROUND OF THE INVENTION

1. Field of the Invention

This application relates generally to a bagless transfer system for removal of plutonium or other radioactive or hazardous substances from process glove boxes.

2. Discussion of Background

New D.O.E. criteria for long term storage of radioactive wastes prohibits the use of plastic or organic compounds since these compounds may release gases which generate container pressurization problems. Prior transfer systems which relied upon plastic bagout techniques are no longer suitable. Retrofiting existing transfer systems with air purge, double door, or decontamination processes have various limitations as to cost, effectiveness, and user training. Accordingly, there is room for improvement within the art.

SUMMARY OF THE INVENTION

It is therefore an object of this invention to provide a novel and improved apparatus and process for removing plutonium waste from a glovebox containment apparatus.

It is another object of this invention to provide an apparatus and process for packaging nuclear waste which is more practical and economical than prior apparatuses and processes.

It is yet another object of this invention to provide an apparatus and process for packaging plutonium for storage which is compatible with existing glove box containment and handling apparatuses.

These as well as other objects of the invention are provide by an apparatus for removing radioactive material from a glovebox comprising: a first vertical support carrying a vertical positioner along one side; a first horizontal arm in communication at one end with the first vertical positioner and providing a second free end defining a holder; a second vertical support carrying a second vertical positioner along one side; a second horizontal arm in communication at one end with the vertical positioner of the second support, a free end of the second arm carrying a cutter defining at least one circular cutting blade in communication with a central cavity defined by the cutter; a sliding bracket having a first end carried by and moveable along a mid-region length of the second arm and having a second end carrying a rotary welder defining at least one welding tip; and, wherein when the apparatus is positioned beneath a glovebox defining a bottom seal, the holder is provided along a central axis of the seal for receiving and inserting a canister with the seal and in response to movement of the first arm along the vertical positioner, the welder and the cutter in selective communication with the canister and carried above the holder.

DETAILED DESCRIPTION

As seen in reference to FIGS. 1A–1E, a process for the bagless transfer of high level radioactive materials from a glovebox is provided. The process enables the radioactive material to be transferred without external contamination and provides a suitable storage vessel compatible with existing long term storage regulations for nuclear waste.

Figure 1A:
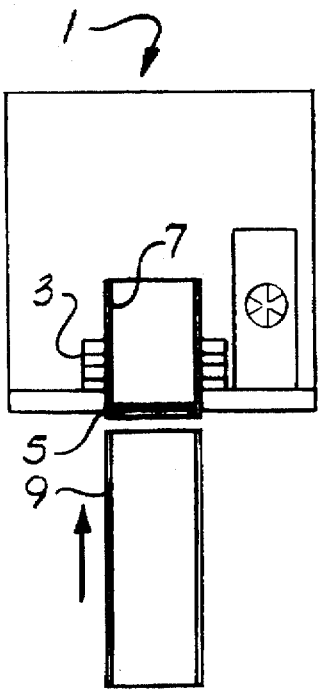
FIGS. 1A–1E are sectional views of a process and apparatus according to this invention.

As seen in FIG. 1A, a typical glove box 1 defines an inner chamber. A series of rubber seals provides a sphincter seal 3 which is positioned adjacent a port 5 located in the floor of the glove box 1. A canister portion 7 initially occupies port 5, seal 3 maintaining the environmental integrity of the glove box chamber.

Figure 1B:
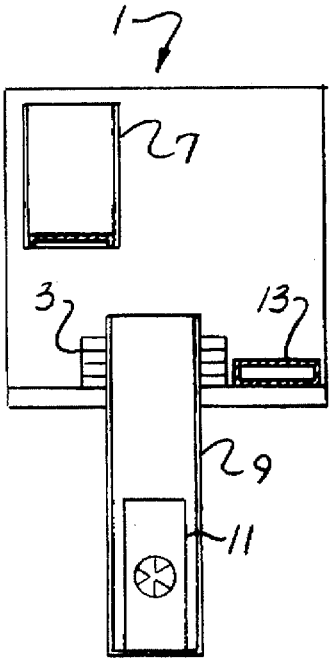
Figure 1C:
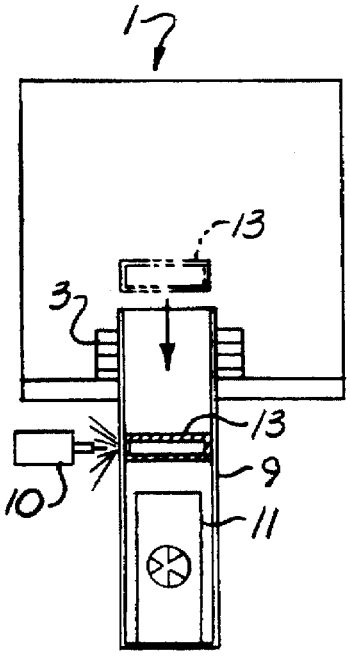
Figure 1D:
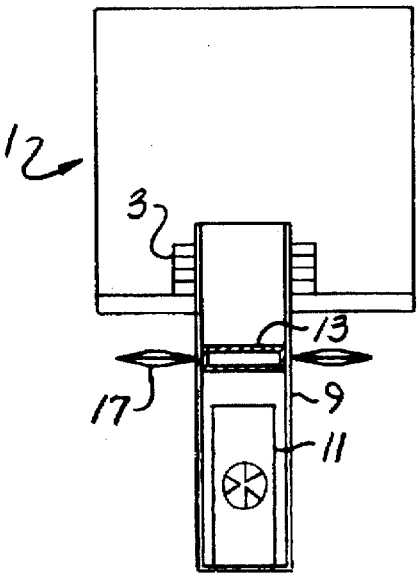

As best seen in FIG. 1A and 1B, a remnant section 7 of a previous canister is displaced by the upward movement and insertion of a new stainless steel canister 9 into the sphincter seal 3. Prepackaged nuclear material contained within an approved holder 11 is place from above inside canister 9. Holder 11 retains the nuclear material in a controlled manner so that subsequent welding and cutting steps do not generate a release of radioactive materials which may otherwise be displaced by vibration and movement.

Figure 3:
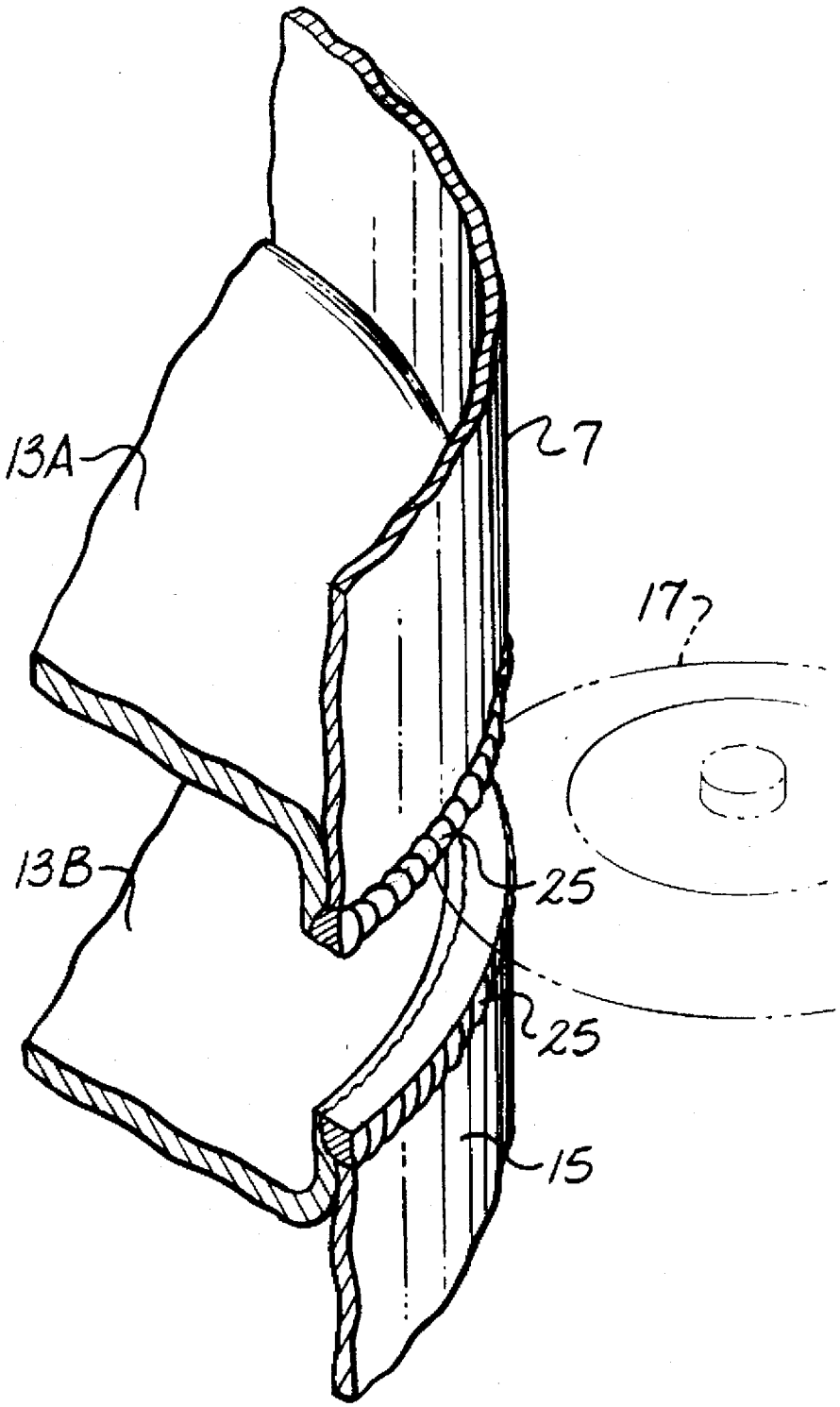
FIG. 3 is an exploded perspective view of a portion of plug and canister following the welding and cutting steps.

A round hollow plug 13 is placed within the round canister 9. Plug 13, also constructed of stainless steel, and canister 9 are designed with tight tolerances between the two structures to ensure a quality weld between the outer plug wall and the inner canister wall. The desired tolerances are within a range of 0.002 inches (0.005 cm) to 0.008 inches (0.020 cm) and are sufficiently tight that the plug will slowly float down the interior of the canister. Canister 9 has a wall thickness of 0.060 inches (0.0152 cm) and preferably defines an inner circular reduced diameter ledge upon which plug 13 will rest. The plug wall thickness of 0.12 inches (0.31 cm) is approximately three times the thickness of the canister wall 0.40 inches (1.02 cm) at the ledge weld site and this combination of materials and thickness has been found to provide the proper weld penetration depth. Plug 13 can be provided by two 304L stainless steel cups which are seal welded together. A plunger (not illustrated) or a plug seating fixture is used to ensure that plug 13 is seated upon the inner ledge of canister 9. Plug 13, as best seen in reference to FIGS. 1C and 3, defines a hollow interior. As seen in reference to FIG. 1C, a rotary tungsten inert gas (TIG) welder 10 is used to fuse the inner wall of canister 9 to an exterior side wall of plug 13. As illustrated, the canister and plug are preferably round to facilitate both the welding process as well as to conform to the shape of the sphincter seal 3.

Figure 1E:
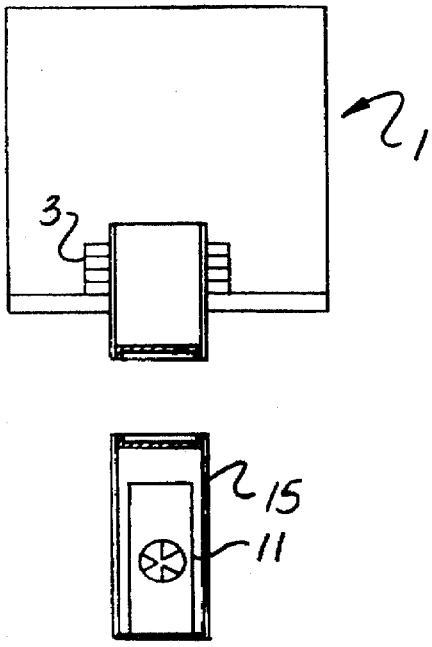

Following welding, a pair of pipe cutter wheels 17 are used to cut along the approximate midpoint of weld 25 (FIG. 3), severing both side walls of the container 9 and plug 13. As seen in FIG. 1E, a lower portion 15 of canister 9 is now separated from the upper canister portion 7, portion 7 maintaining the seal of glove box 1.

Figure 2:
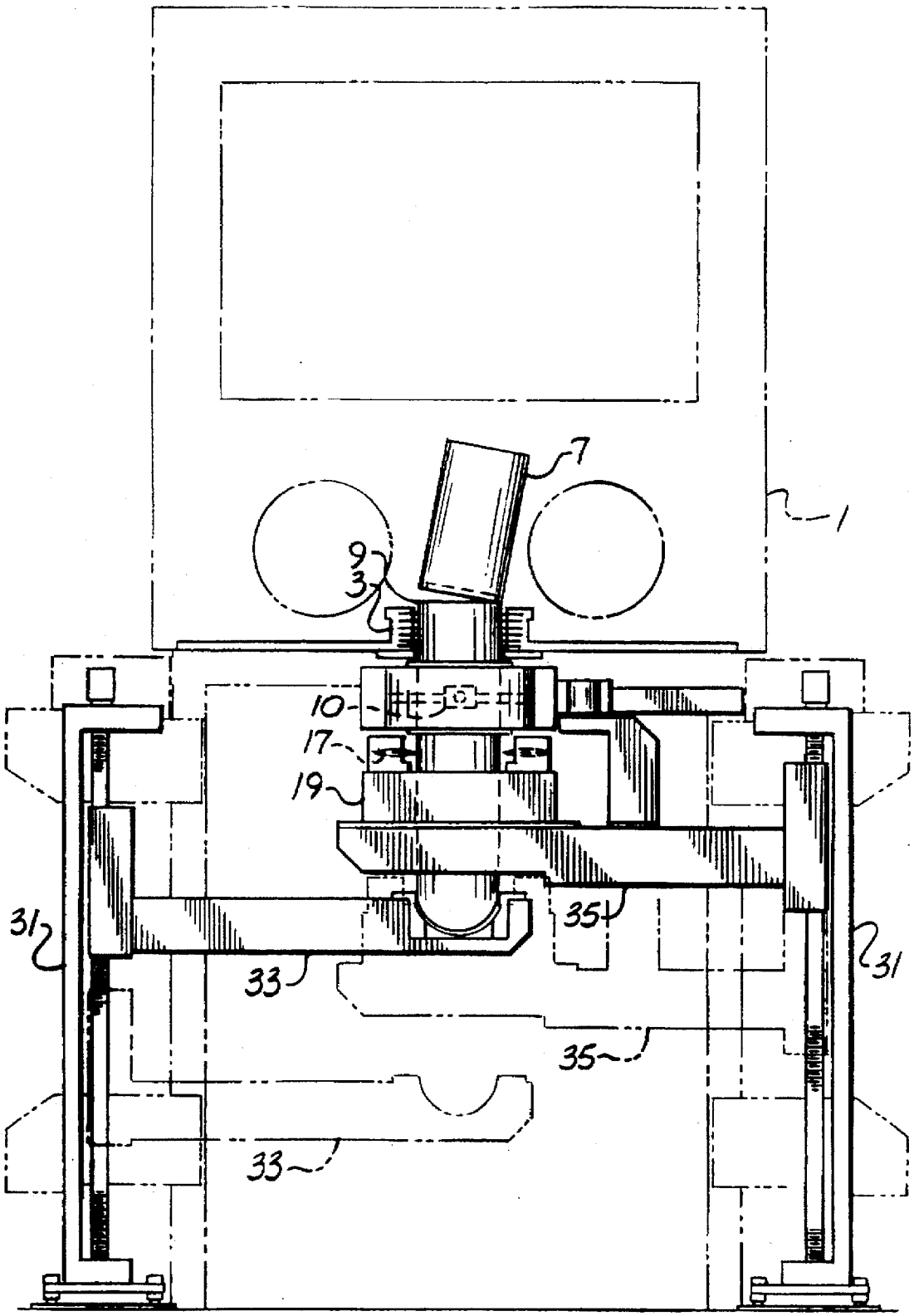
FIG. 2 is a front elevation view of a preferred apparatus for carrying out the invention.

In FIG. 2, a preferred apparatus is set forth for carrying out the present process. As seen from the front, a first vertical slide 31 supports a ACME non-backdriving screw 32. A similar slide 31' supports a second ACME non-backing screw 32'. Optional bracing or interconnected support framing can be provided. However, for permanent installations, bolting the vertical slides to the work floor is preferred.

One end of an arm 33 engages screw 32. A free end of arm 33 defines a mated receptacle 34 for receiving a bottom portion of a canister 9. As seen in FIG. 2, canister 9 is depicted as having a rounded bottom portion. However, a variety of different canister shapes and corresponding receptacles 34 can be provided. A second screw carried arm 35 is provided on the opposite front upright. A free end of arm 35 carries a cutter 19, cutter 19 further defining a pair of circular cutter blades 17. One source for a such a commercial motor driven clam-shell type cutter is Tri-Tool Inc, Rancho Cordova, Calif., USA. Cutter unit 19 has been modified with round pipe cutting wheels 17, instead of typical cutter blades. The modification has been found to virtually eliminate metal chips from being generated by the cutting process.

A rotary TIG welding head 10 and surrounding housing is supported by bracket 37 which is attached to arm 35. TIG welders are well known in the art for butt welding pipes and similar materials. Welder 10 is hinged in the middle and bracket 37 is slidable along arm 35 to facilitate movement of the welder. An electromechanical screw is used to open and close the welder about its hinged pivot. As the welder is closed, inner clamps 45 are secured about canister 9. The lower band clamp 45 has been slightly modified by the provision of a gradual taper of thickness along the width of the clamp so that the lowermost clamp edge provides a funnel-like feature for guiding an inserted canister into proper position. The taper compensates for slight alignment errors of the canister and correctly positions the canister for insertion into seal 3.

Support arms 33 and 35 are responsive to well known gear drive components 41 and 43 such as direct drive or belt operated systems used to engage screws 32 and 32'. Arms 33 and 35 are raised and lowered along the ACME screws. The operation of the welder, cutter, and subsequent steps of removal of a sealed canister 11 and insertion of a new container 9 are all controllable through one or more microprocessors. One such controller for the welder 10 is available from ARC Machines, Inc. Pacoima, Calif. (model #207) which allows repetitive weld patterns to be accurately duplicated. Other well known processors are used to regulate the motor drives and automation of the positioning and sequential operation of the welder, cutter, and holder portions of the apparatus.

The apparatus seen in FIG. 2 allows the preprogrammed operating steps set forth in FIGS. 1A–1E. As seen in FIG. 2, arm 33 is responsive to a programmable drive unit 41 which raises the arm 33 carrying a canister 9 in mated receptacle 34. Welder 10 pivots open along one side to facilitate the insertion of canister 9 into sphincter seal 3, thereby displacing remnant portion 7. The radioactive storage material is placed inside canister 9 and plug 13 is placed upon the inner circumferential ledge of canister 9. Rotary welder 10 is positioned vertically (lowered) by movement of arm 35 responsive to a programmable drive unit 43 so that a welding tip is aligned with the position of plug 13. Welder 10 pivots closed and clamps 45 secure the welder to the canister. Following the formation of weld 25 (FIG. 3) which joins the inner canister wall to the outer plug wall, the clamps 45 release and welder 10 pivots to an open position. Following cooling, arm 35 raises cutter 19, positioning blades 17 along a midpoint of weld 25. Rolling blades 17 sever the weld 25 resulting in a sealed lower canister 15 and a remnant section 7 in which the upper half of welded plug 13 maintains the sealed environment of glove box 1. Arm 33 is then lowered, permitting the removal of sealed canister 15 from the apparatus. The above steps are then repeated using a new canister 9.

It is preferred that the above process steps be automated. It is well within the ordinary skill of one within the art to provide software and microprocessor unit(s) to facilitate the above steps. As a result, minimal training is required for workers to operate and oversee the above process. Prior art transfer systems relied on lasers to carry out both the welding and severing steps. The present invention offers substantial improvements in that less expensive materials are used, uses equipment which requires less training and maintenance, and carries out the process using an apparatus which is compatible in size with space requirements for retrofiting existing glove box installations. Space limitations of existing nuclear glove box sites require a process using compact component parts. Some typical glove box apparatuses require that the bagless transfer process and apparatus be placed in an area approximately 1 meter wide, 1 meter high, and having a depth of 0.75 meters.

Prior art laser cutters and welders are not suitable for use in these small areas. Space requirements alone often preclude the use of laser technology and the accompanying array of mirrors, prisms, and drive motors required to rotate the high energy laser light. Other laser bagout techniques keep the laser unit stationary and rotate the canister. The rotation requires the use of a semifluid ferro-fluidic sphincter seal for environmental integrity of the glove box. Such seals are higher maintenance, are more difficult to use, and requires custom designed equipment to rotate the canister.

Initial equipment costs using laser technology are at least four times higher than that required by the instant invention. In addition, training and maintenance costs of laser-based systems are greater as are space requirements and mandatory buffer regions surrounding the laser. Further, laser-based transfer techniques may pose greater contamination risks since vaporized products are produced by the laser cutting process. Accordingly, any container contamination which may be present, would be further spread by vaporization.

In contrast, the present invention makes use of technology with which existing personnel are familiar. The active welding, cutting and positioning components are sufficiently compact to permit simple retrofitting of existing glove box locations and offers substantial cost savings over laser-based technology. The apparatus and process does not interfere with the routine use of the glovebox by an operator.

It will be apparent to those of skill in the art that various changes and substitutions can be made to the embodiments described herein without departing from the spirit and scope of the present invention as defined by the appended claims.

That which is claimed:

1. A process of handling radioactive material comprising:

providing a glovebox containing radioactive material within an interior of said glovebox;

positioning an apparatus beneath a bottom seal of said glovebox, said apparatus comprising:

a first vertical support carrying a vertical positioner along one side;

a first horizontal arm in communication at one end with said vertical positioner and providing a second free end defining a holder;

a second vertical support carrying a vertical positioner along one side;

a second horizontal arm in communication at one end with said vertical positioner of said second support, a free end of said second arm carrying a cutter defining at least one circular cutting blade in communication with a central cavity defined by said cutter;

a sliding bracket having a first end carried by and moveable along a mid-region length of said second arm and having a second end carrying a rotary welder defining at least one welding tip;

inserting a circular canister within a seal of said glovebox, an interior of said canister being in communication with said glovebox interior;

placing said radioactive material within said interior of said canister;

providing a hollow plug for said canister;

positioning said plug at a predetermined location within an interior of said canister;

positioning said rotary welder around an exterior of said canister, said rotary welder tip positioned opposite of said predetermined location;

welding an interior wall portion of said canister to an exterior wall portion of said plug;

positioning said circular cutting blades opposite said weld;

severing said weld with said cutter blades along a mid-point of said weld, thereby providing a detached and sealed canister housing said waste comprising a lower portion of said canister and having a welded top comprising a lower plug half; and maintaining an environmentally sealed condition of said glovebox by formation of a barrier provided by an upper plug half welded to an upper canister portion.

2. A process of handling radioactive material comprising:

providing a glovebox containing radioactive material within an interior of said glove box;

inserting a circular canister within a seal of said glovebox, an interior of said canister being in communication with said glovebox interior;

placing said radioactive material within said interior of said canister;

providing a hollow plug for said canister;

positioning said plug at a predetermined location within an interior of said canister;

positioning a circular welding apparatus around an exterior of said canister, said welding apparatus providing a welding tip, said tip positioned opposite said predetermined location;

welding an interior wall portion of said canister to an exterior wall portion of said plug;

providing a circular cutting apparatus defining a pair of circular cutting blades;

positioning said cutting apparatus opposite said weld;

severing said weld with said cutter blades along a mid-point of said weld, thereby providing a detached and sealed canister housing said waste comprising a lower portion of said canister and having a welded top comprising a lower plug half; and, maintaining an environmentally sealed condition of said glovebox by formation of a barrier provided by an upper plug half welded to an upper canister portion.

3. An apparatus for removing radioactive material from a glovebox comprising:

a first vertical support carrying a vertical positioner along one side;

a first horizontal arm in communication at one end with said vertical positioner and providing a second free end defining a holder;

a second vertical support carrying a vertical positioner along one side;

a second horizontal arm in communication at one end with said vertical positioner of said second support, a free end of said second arm carrying a cutter defining at least one circular cutting blade in communication with a central cavity defined by said cutter;

a sliding bracket having a first end carried by and moveable along a mid-region length of said second arm and having a second end carrying a rotary welder defining at least one welding tip;

wherein when said apparatus is positioned beneath a glovebox defining a bottom seal, said holder is provided along a central axis of said seal for receiving and inserting a canister with said seal and in response to movement of said first arm along said vertical positioner, said welder and said cutter in selective communication with said canister and carried above said holder.

4. The apparatus according to claim 3 wherein said cutter further comprises a plurality of blades surrounding a passage defined by said cutter and in alignment with a vertical axis of said glove box seal.

5. The apparatus according to claim 3 wherein said welder further provides a lower clamp having a tapered thickness along a width of said clamp, said taper providing a funnel shaped guide for receiving a canister from said holder.

* * * * *

UNITED STATES PATENT AND TRADEMARK OFFICE

CERTIFICATE OF CORRECTION

PATENT NO. : 5,740,545
DATED : April 14, 1998
INVENTOR(S) : David N. Maxwell, et. al.

It is certified that error appears in the above-identified patent and that said Letters Patent is hereby corrected as shown below:

Title page, item [75],

Please correct the second inventor's name to read "Robert H. Jones", instead of "Robert H. Hones".

Signed and Sealed this

Twentieth Day of October, 1998

Bruce Lehman

*Attest:*

BRUCE LEHMAN

*Attesting Officer*

*Commissioner of Patents and Trademarks*